US006056052A

United States Patent [19]

Mullen et al.

[11] Patent Number: 6,056,052

[45] Date of Patent: May 2, 2000

[54] RETRIEVABLE TORQUE-THROUGH PACKER HAVING HIGH STRENGTH AND REDUCED CROSS-SECTIONAL AREA

[75] Inventors: Bryon D. Mullen, Carrollton; Ralph H. Echols; Marion D. Kilgore, both of Dallas, all of Tex.

[73] Assignee: Halliburton Energy Services, Inc., Dallas, Tex.

[21] Appl. No.: 09/273,793

[22] Filed: Mar. 22, 1999

Related U.S. Application Data

[62] Division of application No. 08/606,706, Feb. 26, 1996, Pat. No. 5,884,699.

[51] Int. Cl.[7] ..... E21B 23/06; E21B 33/128

[52] U.S. Cl. ..... 166/134; 166/138

[58] Field of Search ..... 166/134, 138, 166/118, 123, 139

[56] References Cited

U.S. PATENT DOCUMENTS

| | | | |
|---|---|---|---|
| 3,678,998 | 7/1972 | Cockrell et al. | 166/134 |
| 3,744,563 | 7/1973 | McGill | 166/134 |
| 3,749,166 | 7/1973 | Young | 166/134 |
| 4,921,045 | 5/1990 | Richardson | 166/134 |
| 5,441,111 | 8/1995 | Whiteford | 166/134 |

*Primary Examiner*—William Neuder
*Attorney, Agent, or Firm*—William M. Imwalle; Marlin R. Smith

[57] ABSTRACT

A packer for use in subterranean wellbores provides efficient utilization of its cross-sectional area with mechanisms therein for anchoring, sealing, and torquing through the packer. In a preferred embodiment, a retrievable packer has a tubular mandrel, rubbers disposed on the mandrel, upper and lower compression members axially straddling the rubbers, a barrel-type casing slip, upper and lower wedges axially straddling the casing slip, a release mechanism, and a series of threaded load-distributing components which help to prevent collapse of the mandrel.

23 Claims, 8 Drawing Sheets

RETRIEVABLE TORQUE-THROUGH PACKER HAVING HIGH STRENGTH AND REDUCED CROSS-SECTIONAL AREA

This is a division of application Ser. No. 08/606,706, filed Feb. 26, 1996, now U.S. Pat. No. 5,884,699, such prior application being incorporated by reference herein in its entirety.

BACKGROUND OF THE INVENTION

The present invention relates generally to retrievable packers for use in subterranean wellbores and, in a preferred embodiment thereof, more particularly provides a retrievable packer which may be torqued through, and which has high strength and a reduced cross-sectional area.

Retrievable packers are typically conveyed into a subterranean wellbore suspended from a service tool which is, in turn, suspended from tubing extending to the earth's surface. Such packers are generally utilized for two main purposes—to provide a releasable anchor for preventing longitudinal movement relative to the wellbore, and to provide a releasable annular seal between portions of the wellbore above and below the packer.

When the wellbore is lined with tubular protective casing, the anchor function of a packer is usually performed by hardened jaw-like gripping members known as "slips" which, contrary to their name, act to prevent slippage of the packer within the casing. The slips are typically designed to extend radially outward from the packer and, when extended, bite into the casing's inner surface. In this manner, the packer's slips permit forces to be applied to the packer without resulting in movement of the packer within the wellbore. A type of slip known as a "bidirectional" slip permits both tensile and compressive forces to be applied to the packer without producing longitudinal movement of the packer relative to the casing.

The sealing function of the packer is typically performed by multiple ring-shaped "rubbers" located in axially compressible annular recesses formed on the packer's exterior surface. When compressed, the recesses force the rubbers radially outward to seal against the inner surface of the casing. Generally, the axial compression of the recess coincides with the radially outward extension of the slips to thereby "set" the packer in the casing.

It will be appreciated from the foregoing that complex mechanical and/or hydraulic mechanisms are required to efficiently achieve the main functions of the packer. The mechanisms necessarily are located in cross-sectional areas between the inner and outer surfaces of the packer. In recent years it has become increasingly important to compress those mechanisms into smaller and smaller cross-sectional areas of packers to provide for increased flow area through the packers. For example, in some fracturing, acidizing, and gravel packing operations, and combinations thereof, it is highly desirable to utilize a packer having a large flow area therethrough, while simultaneously having the ability to seal against high pressures and resist movement due to high loads applied to the packer.

In past packer designs, as with most engineering designs, trade-offs were typically made in an effort to optimize the designs for intended uses of the packers. In general, a packer which had increased anchoring or pressure sealing capabilities would consequently have a reduced flow area. Conversely, a packer which had a large flow area would usually be restricted in its anchoring and sealing capabilities. These past packer designs are, therefore, unsuitable for use in those operations requiring large flow area, high pressure sealing, and anchoring against high loads.

Another desirable characteristic of retrievable packers is the ability to apply torque through the packer while running in or out of the wellbore. Such torque may be used to enable the packer to pass an obstruction in the casing, operate other equipment, etc. At times, it is also desirable for the packer to be rotated within the casing when torque is applied to the packer and for the packer to rotate as a unit, that is, with all, or substantially all, portions of the packer rotating together.

Mechanisms for permitting torque-through of a packer and for preventing relative rotation of packer portions, as with the anchoring and sealing mechanisms discussed above, are necessarily located in the cross-sectional area of the packer. Therefore, in the past, these features of a packer design typically resulted in decreased flow area, reduced anchoring ability, reduced sealing ability, or a combination thereof.

From the foregoing, it can be seen that it would be quite desirable to provide a packer which efficiently utilizes its cross-sectional area to thereby simultaneously achieve a large flow area, high resistance to axial and radial forces applied thereto, high pressure sealing capability, the ability to torque through the packer, and the ability to prevent relative rotation of portions of the packer. It is accordingly an object of the present invention to provide such a packer.

SUMMARY OF THE INVENTION

In carrying out the principles of the present invention, in accordance with an embodiment thereof, a packer is provided which is a retrievable torque-through packer, utilization of which permits high rates of flow therethrough. The packer's cross-sectional area includes mechanisms which anchor the packer against high loads, seal against high pressures, and prevent relative rotation of portions of the packer.

According to a preferred embodiment of the present invention, in which a variety of unique features thereof are cooperatively combined, a packer is provided which includes a tubular mandrel, casing slips disposed on the mandrel's exterior surface, rubbers disposed on the mandrel's exterior surface, upper and lower compression members for axially compressing the rubbers, upper and lower wedges for radially extending the casing slips, a mandrel slip between the upper compression member and the mandrel, a C-ring release mechanism for releasing the lower wedge for axial displacement relative to the mandrel, a ring in the form of a tubular clutch radially between the casing slips and the mandrel, and a split ring radially between the upper wedge and the mandrel.

The casing slips are barrel-type bidirectional slips with a series of circumferentially spaced apart slots formed thereon. The clutch prevents rotation of the casing slips relative to the mandrel while the packer is being run into the well. It has a series of circumferentially spaced apart projections formed thereon for engaging the slots on the casing slips. The clutch also has a sloping upper surface for engaging the casing slips and radially inwardly biasing them when the packer is retrieved after having been set.

The mandrel has two axially extending slots on its exterior surface. The upper wedge carries a pin which extends into one of the slots to prevent relative rotation between the mandrel and the upper wedge. The pin also extends into one of the slots on the casing slips to prevent relative rotation between the upper wedge and the casing slips. The lower wedge carries a key which extends into the other one of the slots on the mandrel. The key prevents relative rotation of the lower wedge relative to the mandrel.

Portions of the mandrel which are subjected to radially inwardly directed loads have threads or axially spaced apart teeth formed thereon in order to distribute the loads across the exterior surface of the mandrel to thereby help prevent collapse of the mandrel. In this way, the mandrel may be designed with a relatively thin cross-section and have a relatively large flow passage therethrough. Series of threads or angled teeth more efficiently utilize the available packer cross-section by eliminating large ramping surfaces conventionally found on packers.

An example of the utilization of threads and axially spaced apart teeth to distribute loads and efficiently compress the packer's cross-section may be found in the mandrel slip. The mandrel slip uses small internal teeth to grip the mandrel exterior surface. External threads on the mandrel slip and mating internal threads on the upper compression member evenly distribute inwardly directed force across the external surface of the mandrel slip, thereby distributing the force across the external surface of the mandrel.

The release mechanism is utilized to release the packer after it has been set. A C-ring is disposed on the mandrel axially downward from a housing and has internal threads which engage threads on the exterior surface of the mandrel. The C-ring also has axially spaced apart external surfaces which are in contact with axially spaced apart internal surfaces on a release sleeve. Such multiple mating surfaces reduce the amount of displacement required to release the C-ring for radially outward flexing to disengage the threads.

The features listed above are among those provided by the disclosed preferred embodiment of the present invention. Other features will become apparent upon consideration of the detailed description set forth hereinbelow. It will be readily appreciated by one of ordinary skill in the art that these features may be utilized individually or in any combination in a packer embodying principles of the present invention.

The use of the disclosed packer does not require flow area to be sacrificed to achieve other capabilities. Modern fracturing, acidizing, gravel packing, and combined operations are, thus, enhanced by use of a packer embodying principles of the present invention.

DETAILED DESCRIPTION

Figure 1A:
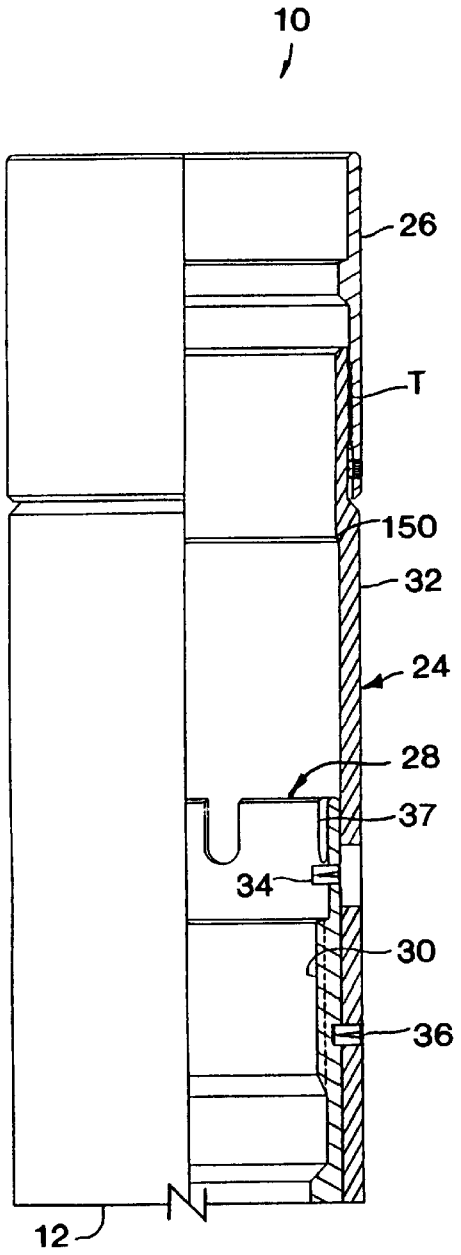
FIGS. 1A–1E are quarter-sectional views of successive axial portions of a packer embodying principles of the present invention, the packer being configured for running into a subterranean well, FIG. 1E being an enlarged view of a portion of the packer.

Illustrated in FIGS. 1A–1D is a packer 10 which embodies principles of the present invention. The packer 10 is shown in a configuration in which the packer is run into a subterranean well. In the following detailed description of the embodiments of the present invention representatively illustrated in the accompanying figures, directional terms such as "upper", "lower", "upward", "downward", etc. are used in relation to the illustrated packer 10 as it is depicted in the accompanying figures. It is to be understood that the packer 10 may be utilized in vertical, horizontal, inverted, or inclined orientations without deviating from the principles of the present invention. For convenience of illustration, FIGS. 1A–1D show the packer 10 in axial portions, but it is to be understood that the packer is a continuous assembly, lower end 12 of FIG. 1A being continuous with upper end 14 of FIG. 1B, lower end 16 of FIG. 1B being continuous with upper end 18 of FIG. 1C, and lower end 20 of FIG. 1C being continuous with upper end 22 of FIG. 1D.

Referring specifically now to FIG. 1A, the packer 10 includes an upper portion 24 which facilitates setting the packer in casing 146 in a wellbore 148 (see FIGS. 5A–5D). A tubular upper adaptor 26 and tubular top sub 28 enable attachment of the packer 10 to a conventional service tool (not shown) which applies a tensile force to the top sub and a compressive force to the upper adaptor to set the packer. A downwardly extending and externally threaded portion of the service tool threads into internal threads 30 on the top sub 28 and an external shoulder on the service tool axially contacts the upper adaptor 26. When it is desired to set the packer 10, the downwardly extending and externally threaded portion of the service tool pulls axially upward on the top sub 28, thereby applying the tensile force to the top sub, and the external shoulder on the service tool pushes axially downward on the upper adaptor 26, thereby applying the equal and opposite compressive force to the upper adaptor 26. It will be readily appreciated that other methods may be utilized to apply a tensile force to the top sub 28 and a compressive force to the upper adaptor 26 without departing from the principles of the present invention. For example, service tools are frequently used for setting packers, which service tools do not have provisions for threading into internal threads 30, but utilize a shear pin 34 for releasably applying a tensile force to the top sub 28.

Upper adaptor 26 is threadedly attached to a tubular upper housing 32 which coaxially and externally overlaps the top sub 28. Shear pins 34 and 36 are installed laterally through the upper housing 32 and into the top sub 28. Pin 36 prevents inadvertent setting of the packer 10 by preventing axial movement of the top sub 28 relative to the upper housing 32 until sufficient force has been applied to the top sub and upper adaptor 26 to shear the pin 36. Thus, when the packer 10 sets, top sub 28 moves axially upward relative to the upper housing 32, shearing pin 36.

Pin 34 is driven through the top sub 28 and into the service tool (not shown) to prevent rotational movement of the service tool relative to the top sub. Pin 36 prevents rotational movement of the top sub 28 relative to the upper housing 32. Torque may also be applied to the top sub 28 from the service tool by means of eight circumferentially spaced apart slotted openings 37 (only two of which are visible in FIG. 1A) in order to rotate the packer 10. Rotation of the packer 10 is desirable in certain circumstances, such as when an obstruction or debris is encountered as the packer is being run into the well. Since it is also beneficial for external portions of the packer 10 to rotate in those circumstances, the packer includes specially designed features, more fully described hereinbelow, which enable the external portions to rotate when torque is applied to the top sub 28 from the service tool.

Figure 1B:
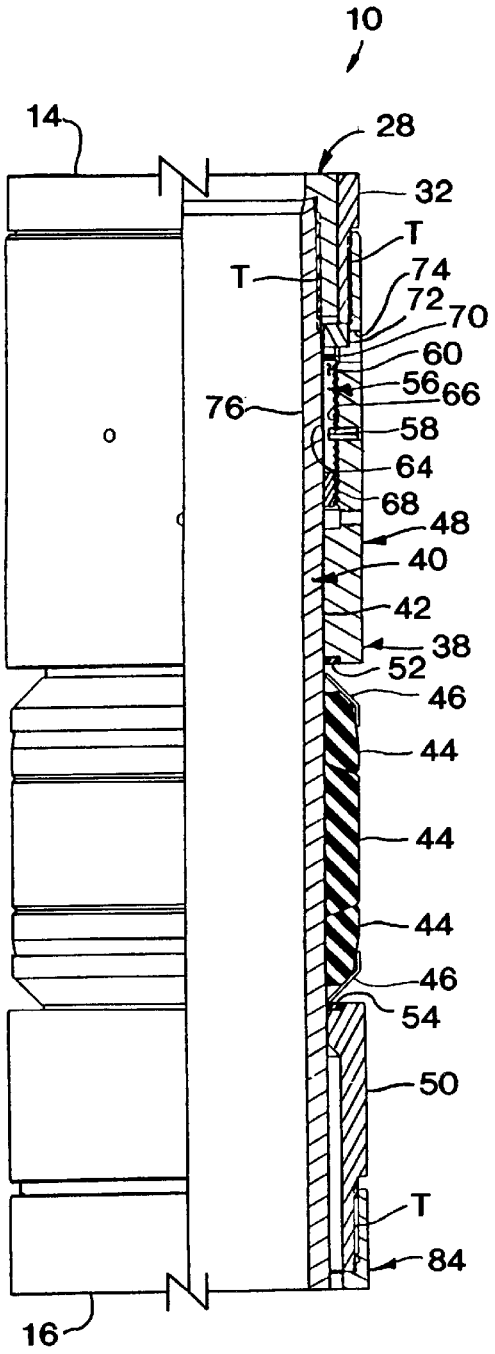

Referring specifically now to FIG. 1B, packer 10 also includes a sealing portion 38 which operates to effect an annular seal between the packer and the casing 146 when the packer is set (see FIGS. 5A–5D). A tubular mandrel 40 is threadedly attached to the top sub 28 and extends downwardly therefrom. The tubular mandrel 40 has a generally smooth exterior surface 42 onto which three rings 44 are externally and slidingly disposed. The rings 44 are known to those skilled in the art as packer "rubbers" and may be made of a suitable elastomeric material for the temperatures and pressures which may be experienced while the packer 10 is set in the well. Axially straddling the rubbers 44 are two partially conical protective sleeves 46 which partially outwardly overlap the rubbers. The sleeves 46 provide a measure of protection against abrasion of the rubbers 44 as the packer 10 is being run into the well and protect against extrusion of the rubbers 44 radially intermediate the packer and casing 146 when the packer is set (see FIGS. 5A–5D).

A tubular upper compression member 48 is threadedly attached to the upper housing 32 and extends axially downward therefrom. The upper compression member 48 slidingly engages the exterior surface 42 of the mandrel 40, such that when the packer 10 is set and the mandrel 40 moves axially upward with the top sub 28 relative to the upper housing 32, the upper compression member will move axially downward relative to the mandrel and contact the upper one of the sleeves 46 to thereby compress the rubbers 44 between the upper compression member and a tubular lower compression member 50. The lower compression member 50 also slidingly engages the exterior surface 42 of the mandrel 40, such that the upper and lower compression members 48 and 50 axially straddle the rubbers 44 and protective sleeves 46.

Anti-extrusion rings 52 and 54 are carried on upper and lower compression members 48 and 50, respectively, and slidingly engage the exterior surface 42 of the mandrel 40. When the packer 10 is set, the anti-extrusion rings 52 and 54 prevent extrusion of the rubbers 44 radially intermediate the upper and lower compression members 48 and 50, respectively. Applicants prefer for anti-extrusion rings 52 and 54 to be conventional radially inwardly biased spiral rings so that no radial gap exists between the rings and the exterior surface 42 of the mandrel 40.

A specially designed tubular mandrel slip 56 is contained radially intermediate the upper compression member 48 and the mandrel 40. The mandrel slip 56 prevents axially downward movement of the mandrel 40 relative to the upper compression member 48, thereby maintaining compression of the rubbers 44 between the compression members 48 and 50 after the packer 10 has been set. A pin 58, installed laterally through the upper compression member 48 and into one of a series of circumferentially spaced apart slots 60 extending partially axially through the mandrel slip 56, prevents rotation of the mandrel slip relative to the upper compression member. Although only one axially downwardly extending slot 60 is visible in FIG. 1B, mandrel slip 56 includes multiple slots 60 which circumferentially alternate between axially upwardly and axially downwardly extending orientations to provide flexibility to the mandrel slip. Another axially extending slot 62, not visible in FIG. 1B (see FIG. 7B), extends completely axially through the mandrel slip 56 and permits the mandrel slip to be radially inwardly compressed.

Mandrel slip 56 includes a series of axially spaced apart circumferentially formed teeth 64 for gripping the exterior surface 42 of the mandrel 40. An enlarged view of the mandrel slip 56 is shown in FIG. 1E. Preferably, the teeth 64 are hardened so that they bite into the surface 42. Teeth 64 may be separately formed or, preferably, may be spirally formed as threads having a pitch of approximately 0.06 inch., For unidirectional gripping of the mandrel 40 (i.e., preventing axially downward, but not axially upward, movement of the mandrel 40 relative to the upper compression member 48), the teeth 64 are axially upwardly angled.

Mandrel slip 56 is radially inwardly biased to grip the exterior surface 42 of the mandrel 40 by ramping contact between external threads 66 formed on the mandrel slip and cooperatively shaped internal threads 68 formed on the upper compression member 48. For radially inward biasing of the mandrel slip 56 when the mandrel slip is biased axially downward, the external threads 66 are preferably radially inclined on their downwardly facing flanks and the cooperatively shaped internal threads are preferably radially inclined on their upwardly facing flanks. Note that the mandrel slip 56 will be biased axially downward, and will, thus, be radially inwardly biased, when teeth 64 are in gripping engagement with the external surface 42 of the mandrel 40 and the mandrel is axially downwardly biased relative to the upper compression member 48 (e.g., when the packer 10 is set). To provide an initial downwardly biasing force to thereby initially radially inwardly bias the mandrel slip 56, a conventional wavy spring 70 is axially compressed between the mandrel slip and a spacer ring 72 disposed axially intermediate the upper housing 32 and the upper compression member 48. Adjacent the spacer 72 is a port 74 which extends laterally through the upper compression member 48 and provides fluid communication between the wellbore 148 and the top sub 28, so that a vacuum is not created between the top sub and the upper compression member when the top sub moves axially upward as the packer 10 is set.

Axially spaced apart teeth 64 and axially extending threads 66 and 68 act to distribute forces resulting from the compression of the rubbers 44, and from the radially outward ramping of the casing slips described hereinbelow, over the external surface 42 of the mandrel 40. In this way, the mandrel slip 56 helps to prevent collapse of the mandrel 40, permitting the mandrel to have a large inner diameter 76 for flow of fluids therethrough.

Figure 1C:
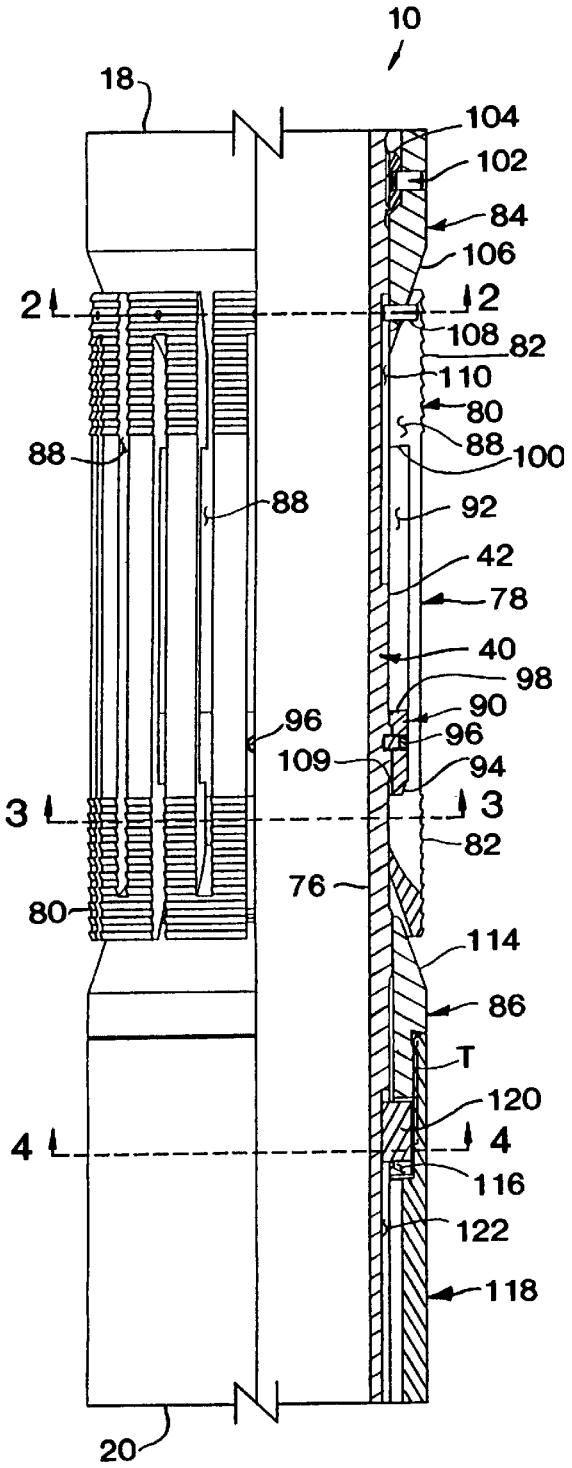
Figure 5A:
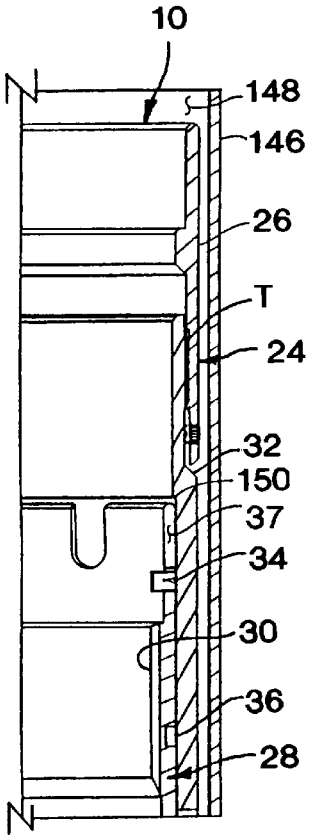
FIGS. 5A–5D are quarter-sectional views of successive axial portions of the packer, illustrating a configuration thereof wherein the packer is set in casing within the well.
Figure 5B:
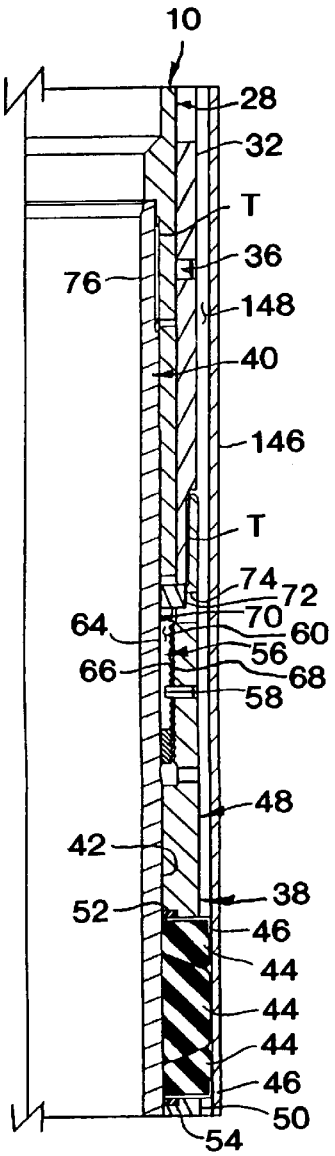
Figure 5C:
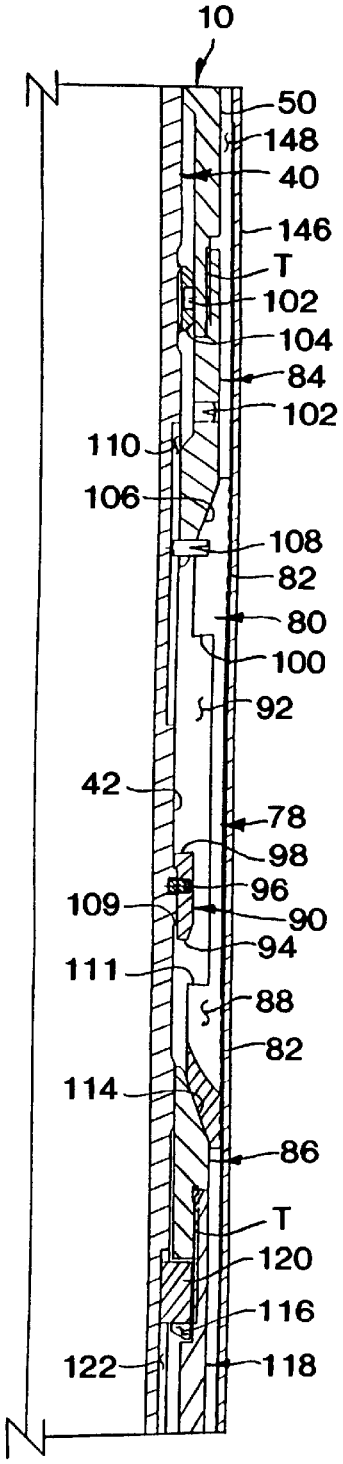

Referring specifically now to FIG. 1C, packer 10 includes a casing slip portion 78 for anchoring the packer against axial movement relative to the casing 146 (see FIG. 5C). When the packer 10 is set, casing slips 80 extend radially outward and axially spaced apart hardened circumferential teeth 82 bite into the casing 146. The radially outward movement of the casing slips 80 is due to ramping engagement of the slips with a tubular upper wedge 84 and a tubular lower wedge 86, which, together, axially straddle the casing slips.

The casing slips 80 are of the bidirectional type known to those skilled in the art as "barrel-type" slips, meaning that they are formed from a single piece of tubular material in which a series of circumferentially spaced apart, alternately upwardly and downwardly axially extending, slots 88 have been formed. Due to the resulting material removal, the casing slips 80 are flexible and may be radially outwardly expanded and inwardly compressed. Teeth 82 are preferably externally formed on axially opposite ends of the casing slips 80, such that when the casing slips are radially outwardly extended, the teeth 82 are radially inwardly supported by the upper and lower wedges 84 and 86.

The casing slips 80 are in sliding engagement with the external surface 42 of the mandrel 40. A ring in the form of a tubular clutch 90 is disposed radially intermediate the casing slips 80 and the mandrel 40 in an undercut 92 formed on the casing slips, and is attached to the mandrel with fasteners 96 which extend laterally through the clutch and into the mandrel. The clutch 90 has a series of circumferentially spaced apart and axially downwardly extending projections 94 formed thereon which, when inserted in the slots 88 of the casing slips 80, prevent rotation of the casing slips relative to the mandrel 40. While the packer 10 is being run into the well, the clutch 90 prevents axially upward movement of the casing slips 80 relative to the mandrel 40. The clutch 90 also has an axially upwardly and radially outwardly sloping upper end surface 98 which, when it is desired to release the packer 10 after it has been set, engages a cooperatively shaped downwardly facing surface formed on the casing slips 80 (see FIG. 7C) to help radially inwardly retract the casing slips as will be described in further detail hereinbelow.

Upper wedge 84 is threadedly attached to the lower compression member 50 and radially outwardly overlies the mandrel 40. Upper wedge 84 is releasably secured against axial movement relative to the mandrel 40 by two shear pins 102, only one of which is visible in FIG. 1C. Shear pins 102 extend laterally through the upper wedge 84 and into a split ring 104. Split ring 104 is radially outwardly and threadedly attached to the mandrel 40 and is axially split (see FIG. 7B) to permit it to be radially outwardly expanded for installation onto the mandrel. In this way, the mandrel 40 does not need to be undercut to provide for installation of the split ring 104, permitting the mandrel to maintain its exterior surface 42 and, thus, does not require a decrease in the inner diameter 76 in this portion 78 of the packer 10. The threaded attachment of the split ring 104 to the mandrel 40 axially distributes forces applied to the split ring over the exterior surface 42 of the mandrel 40, contributing to the strength of the mandrel. The split ring 104 prevents axially upward movement of the upper wedge 84 relative to the mandrel 40 while the packer 10 is being run into the well. After the packer 10 has been set and released, the split ring 104 is in contact with the lower compression member 50 and thereby prevents axially downward displacement of the lower compression member relative to the mandrel 40 (see FIG. 7B).

When the packer 10 is set, a downwardly facing exterior conical surface 106 formed on the lower end of the upper wedge 84 rampingly contacts the casing slips 80, thereby radially outwardly biasing the casing slips. Two shear pins 108 (only one of which is visible in FIG. 1C) extend laterally through the upper wedge 84 and into two of the slots 88 on the casing slips 80. The shear pins 108 prevent rotation of the casing slips 80 relative to the upper wedge 84. Each of shear pins 108 also extend laterally into one of two axially extending slots 110 (only one of which is visible in FIG. 1C) formed on the exterior surface 42 of the mandrel 40. The shear pins 108, thus, also prevent rotation of the upper wedge 84 relative to the mandrel 40, but permit axially downward movement of the upper wedge relative to the mandrel.

While the packer 10 is being run into the well, a radially outwardly and axially downwardly sloping shoulder 109 formed on the exterior surface 42 of the mandrel 40 engages a complementarily shaped sloping surface 111 (see FIG. 5C) formed on the casing slips 80 to radially inwardly bias the casing slips and prevent axially upward displacement of the casing slips relative to the mandrel 40.

Figure 2:
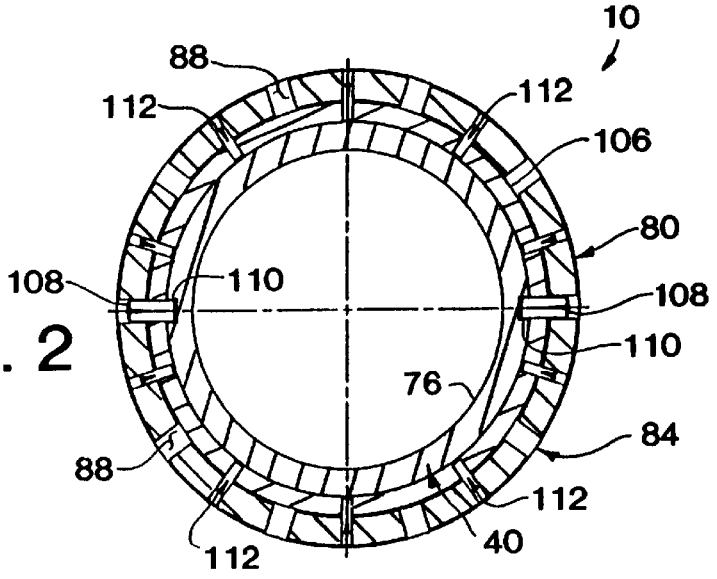
FIG. 2 is an enlarged scale cross-sectional view through the packer, taken along line 2—2 of FIG. 1C.

Referring additionally now to FIG. 2, a cross-sectional view of the packer 10 taken along line 2—2 of FIG. 1C is shown. In this view the manner in which the casing slips 80, the upper wedge 84, and the mandrel 40 are interconnected may be more clearly seen. Ten shear pins 112 extend radially through the casing slips 80 and into the upper wedge 84 conical surface 106. Shear pins 112 releasably secure the casing slips 80 against axial movement relative to the upper wedge 84 until the packer 10 is set, thereby preventing inadvertent setting if the packer is picked up while it is being run into the well.

Figure 3:
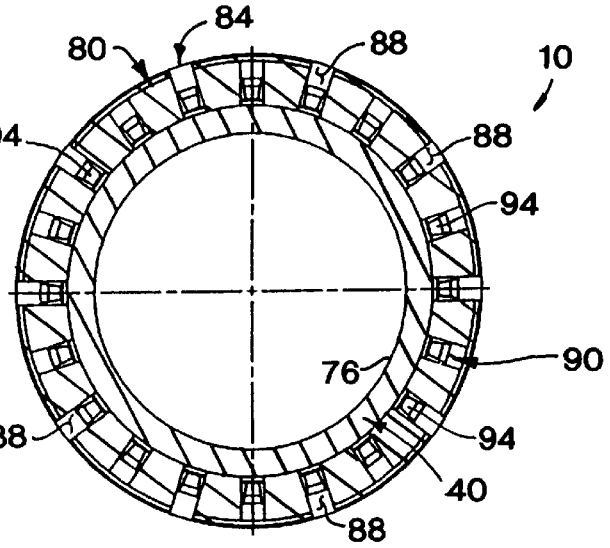
FIG. 3 is an enlarged scale cross-sectional view through the packer, taken along line 3—3 of FIG. 1C.

Referring additionally now to FIG. 3, a cross-sectional view of the packer 10 taken along line 3—3 of FIG. 1C is shown. In this view the manner in which the projections 94 on the clutch 90 engage the slots 88 of the casing slips 80 may be clearly seen.

Referring again to FIG. 1C, lower wedge 86 has an upwardly facing external conical upper end surface 114 formed thereon. When the packer 10 is set, the conical surface 114 rampingly engages the casing slips 80, thereby radially outwardly biasing the casing slips.

A tubular housing 118 is threadedly and coaxially attached to the lower wedge 86 and extends downwardly therefrom. A stop ring 119 is formed on the housing 118 and extends downwardly therefrom radially adjacent the outer surface 42 of the mandrel 40. Two axially upwardly extending slots 116 (only one of which is visible in FIG. 1C) are formed on the lower wedge 86. A key 120 is disposed in each of the slots 116 axially intermediate the lower wedge 86 and the housing 118. Each key 120 extends laterally into an axially extending keyway 122 (only one of which is visible in FIG. 1C) formed on the mandrel 40 exterior surface 42. In this manner, the lower wedge 86 is prevented from rotational movement relative to the mandrel 40. Note, however, that keys 120 do not prevent axially upward movement of the mandrel 40 relative to the lower wedge 86.

Figure 4:
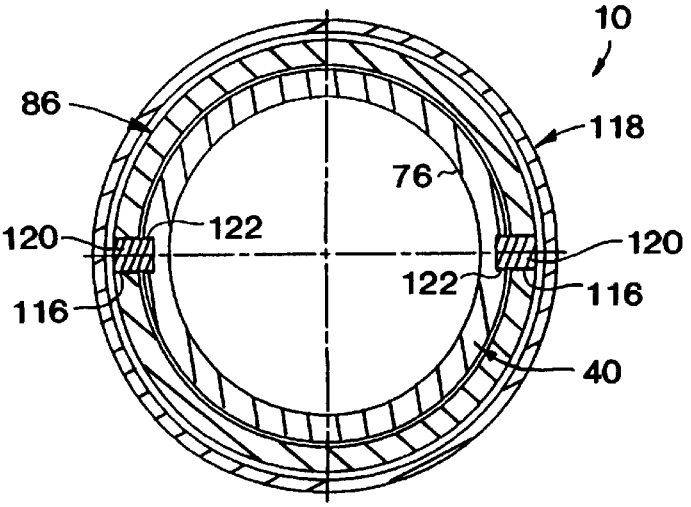
FIG. 4 is an enlarged scale cross-sectional view through the packer, taken along line 4—4 of FIG. 1C.

Referring additionally now to FIG. 4, a cross-sectional view of the packer 10 taken through line 4—4 of FIG. 1C is shown. In this view, the manner in which keys 120 engage slots 116 and keyways 122 may be clearly seen.

Figure 1D:
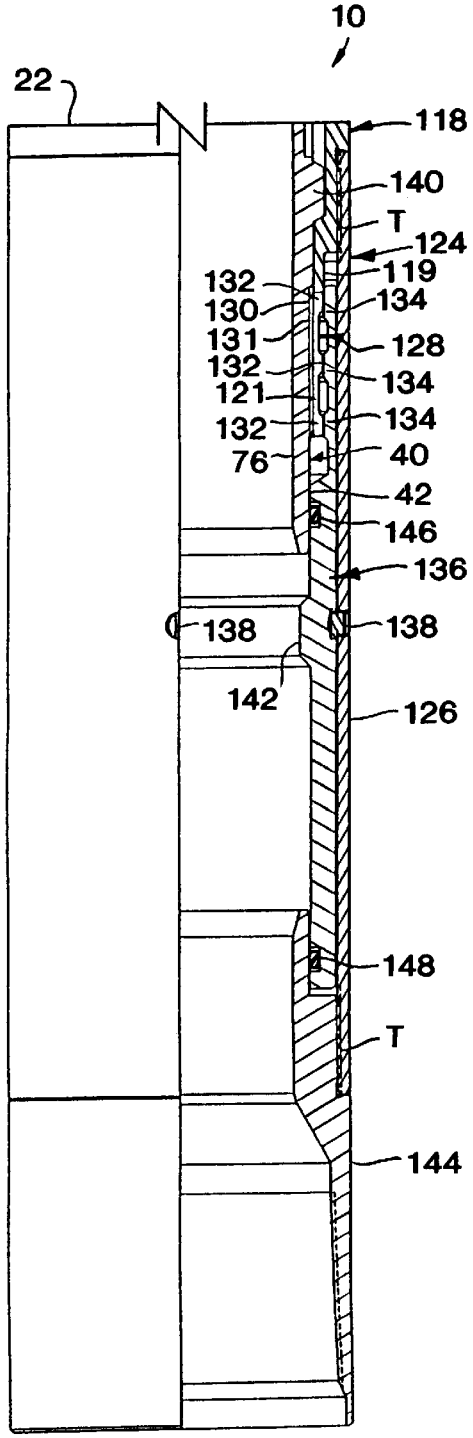
Figure 1E:
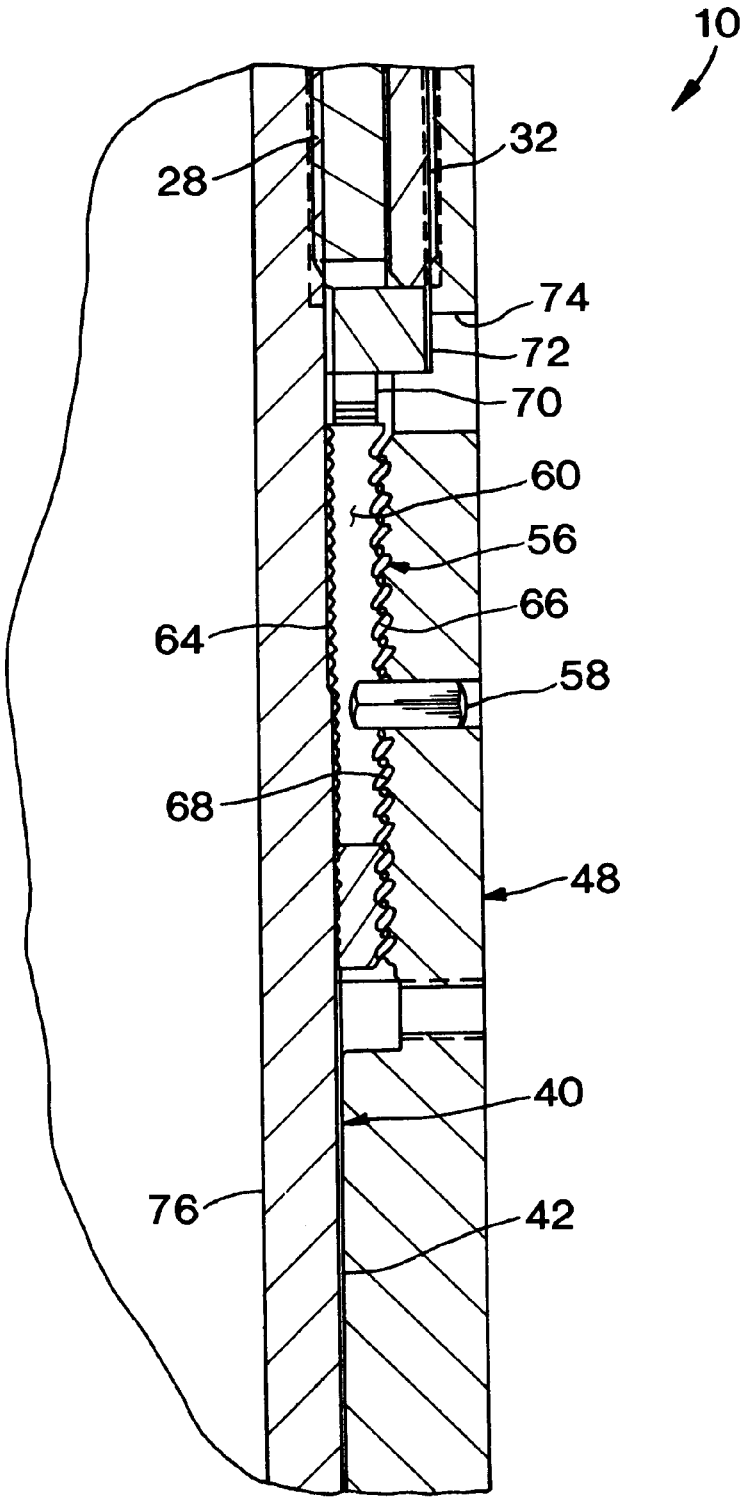

Referring specifically now to FIG. 1D, the packer 10 includes a release portion 124 which, after the packer has been set (see FIGS. 5A–5D), may be utilized to release the packer for retrieval from the well. A tubular outer housing 126 is threadedly and coaxially attached to the housing 118 and extends downwardly therefrom. The outer housing 126 radially outwardly overlaps a C-ring 128 which contacts the stop ring 119 formed on the housing 118 and which has a C shaped cross-section, due to slot 121 axially and radially formed therethrough, enabling it to radially outwardly expand.

C-ring 128 is specially designed to distribute forces applied thereto axially along the exterior surface 42 of the mandrel 40. C-ring 128 grippingly engages the exterior surface 42 of the mandrel 40 with a series of internal and axially spaced apart circumferential teeth 130 which, preferably, are threads. Teeth 130 engage cooperatively shaped teeth 131 formed on exterior surface 42. Thus, when C-ring 128 is radially inwardly retained, stop ring 119 axially contacting the C-ring, axial movement of the housing 118 relative to the mandrel 40 is prevented. Forces tending to displace the housing 118 axially downward relative to the mandrel 40, such as those forces maintaining the casing slips 80 radially outwardly biting into the casing 146 (see FIG. 5C), are distributed by the teeth 130 axially along the exterior surface 42 of the mandrel 40, thus helping to prevent collapse of the mandrel.

C-ring 128 is radially inwardly retained by radial contact between three external and axially spaced apart projections 132 formed on the C-ring, and three internal and axially spaced apart cooperatively shaped projections 134 formed on a tubular release sleeve 136. Release sleeve projections 134 radially outwardly overlap the projections 132 until it is desired to release the housing 118 for axially downward movement relative to the mandrel 40. Release sleeve projections 134 are disposed radially intermediate the outer housing 126 and the C-ring 128.

Release sleeve 136 is releasably secured against axial movement relative to outer housing 126 by four shear screws 138 (only two of which are visible in FIG. 1D) which extend laterally through the outer housing and into the release sleeve 136. When it is desired to release the packer 10 after it has been set, release sleeve 136 is shifted axially upward relative to the outer housing 126 by applying an axially upward force to radially inwardly extending portion 142 formed on the release sleeve, thereby shearing shear screws 138 and displacing projections 134 so that they no longer radially inwardly retain projections 132. C-ring 128 is then permitted to flex radially outward, releasing the housing 118 for axially downward displacement relative to the mandrel 40.

The utilization of multiple axially spaced apart projections 132 and 134 permits a shorter axial displacement of the release sleeve 136 to release C-ring 128 for the amount of contact surface area between them than would be required if only one projection were utilized on the release sleeve and C-ring. Multiple projections 132 and 134 also act to more evenly distribute forces applied to the C-ring 128 axially across the exterior surface 42 of the mandrel 40, thereby helping to prevent collapse of the mandrel.

Radially outwardly extending portion 140 formed on the exterior surface 42 of the mandrel 40 prevents axially upward movement of the housing 118 relative to the mandrel 40, thereby preventing the lower wedge 86 from displacing axially upward and inadvertently setting the packer 10 while it is being run into the well. After the packer 10 has been released, the radially outwardly extending portion 140 contacts the lower wedge 86 adjacent the slots 116 and thereby prevents the lower wedge, housing 118, C-ring 128, outer housing 126, and release sleeve 136 from detaching from the mandrel 40 as the packer is retrieved (see FIG. 7D).

A tubular lower adaptor 144 is threadedly and coaxially attached to the outer housing 126 and extends downwardly therefrom. Lower adaptor 144 permits tubing or other equipment (not shown) to be suspended from the packer 10. When the packer 10 is set in the casing 146 (see FIGS. 5A–5D), the tubing or other equipment attached to the lower adaptor 144 is also anchored against axial displacement relative to the casing 146.

Circumferential seals 146 and 148 are internally disposed on the release sleeve 136 and sealingly engage the mandrel 40 and the lower adaptor 144, respectively. Seals 146 and 148 thereby prevent fluid passage radially intermediate the release sleeve 136 and each of the mandrel 40 and lower adaptor 144, respectively.

Threaded connections T between components of the packer 10 described above are preferably of the type known to those skilled in the art as right hand threads, to permit right hand rotation of the packer as it is being run into the well, if necessary to pass obstructions, etc., without permitting relative rotation between the threadedly connected components. It is to be understood, however, that if this feature of the packer 10 is not desired, the threaded connections T may be differently configured. Additionally, if it is desired to permit left hand rotation of the packer 10 as it is being run into the well, left hand threads may be utilized for the threaded connections T. Where the hereinabove described threaded connection is unrelated to rotation of the packer 10 as a unit, it may be left or right handed without departing from the principles of the present invention.

Thus has been described the packer 10 which uniquely provides for a mandrel 40 having a relatively large inner diameter 76, permitting relatively large flow rates of fluids therethrough. Such relatively large inner diameter 76 is permitted by, for example, the various features of the packer 10 which act to prevent collapse of the mandrel 40 as described hereinabove. Additionally, features of the packer 10 described hereinabove act to maintain relatively large compressive forces on the rubbers 44 without damage to the mandrel 40, permitting the packer to withstand relatively large differential pressures when set in casing 146 within the wellbore 148 (see FIGS. 5A–5D). Furthermore, the packer 10 includes features described hereinabove which act to maintain relatively large radially outwardly biasing forces on the casing slips 80 without damage to the mandrel 40, permitting the packer to withstand relatively large differential pressures and also permitting the packer to anchor relatively large loads against axial displacement relative to the casing 146. Still further, features of the disclosed packer 10 described hereinabove prevent relative rotation of components of the packer, permitting the packer to be rotated as a unit and torqued through while it is being run into the well.

Referring additionally now to FIGS. 5A–5D, the packer 10 is shown set in casing 146 which lines the wellbore 148. As representatively illustrated in FIGS. 5A–5D, the packer 10 is anchored to the casing 146, preventing relative axial movement therebetween, the teeth 82 on the casing slips 80 biting into the casing. A seal has been effected radially intermediate the packer 10 and the casing 146, preventing fluid flow therebetween, the rubbers 44 being axially compressed and radially outwardly extended so that they sealingly contact the casing.

Referring specifically now to FIG. 5A, the upper portion 24 of the packer 10 is shown. The service tool (not shown) has forced the upper housing 32 axially downward relative to the top sub 28. As will be described further hereinbelow, such axially downward movement of the upper housing 32 activates the sealing and anchoring functions of the packer 10. Note that shear pin 36 has sheared, sufficient axially upward force having been applied to the top sub 28 and axially downward force having been applied to the upper adaptor 26 to cause the shear pin 36 to shear.

Referring specifically now to FIG. 5B, the sealing portion 38 of the packer 10 is shown. The mandrel 40 has been displaced axially upward relative to the upper housing 32, the mandrel being attached to the top sub 28. Mandrel slip 56 is grippingly engaging the mandrel 40, teeth 64 biting into the exterior surface 42 of the mandrel, preventing the mandrel from moving axially downward relative to the upper housing 32.

The axially downward movement of the upper housing 32 relative to the mandrel 40 has axially compressed the rubbers 44 between the upper and lower compression members 48 and 50. Protective sleeves 46 have been deformed such that they now extend radially outward to the casing 146, helping to prevent extrusion of the rubbers 44 radially intermediate the packer 10 and the casing. Anti-extrusion rings 52 and 54 prevent extrusion of the rubbers 44 radially intermediate the upper and lower compression members 48 and 50, respectively, and the mandrel 40.

Referring specifically now to FIG. 5C, the casing slip portion 78 of the packer 10 is shown. The axially downward movement of the upper housing 32 relative to the mandrel 40 has forced the upper wedge 84 axially downward, shearing shear pin 102. The axially downward movement of the upper wedge 84 has forced the conical surface 106 to rampingly engage the casing slips 80, forcing the casing slips axially downward and radially outward, the conical surface 114 on the lower wedge 86 also rampingly engaging the casing slips.

Note that the clutch 90, as viewed in FIG. 5C, no longer engages the casing slips 80, the projections 94 having moved axially upward relative to the slots 88 on the casing slips.

Figure 5D:
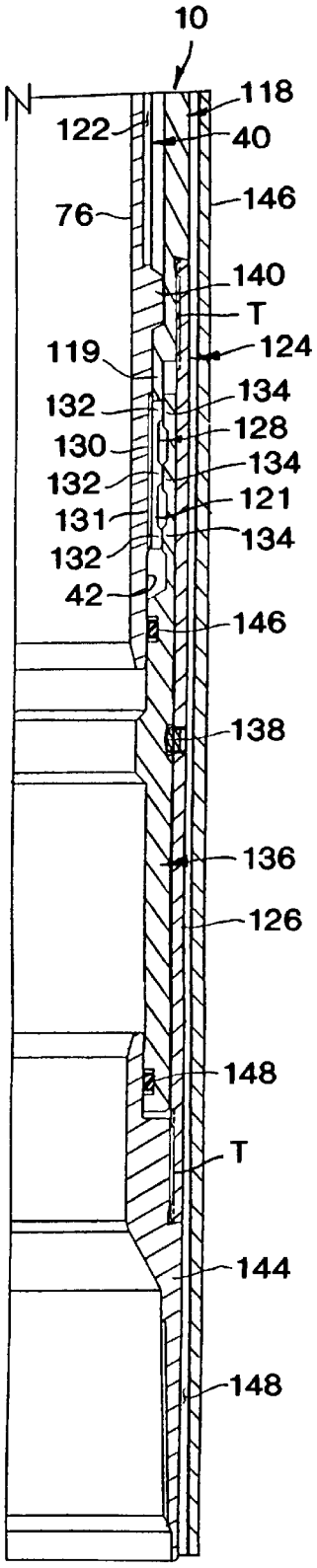

Referring specifically now to FIG. 5D, the release portion 124 of the packer 10 is shown. In this view it can be seen that the housing 118, C-ring 128, release sleeve 136, outer housing 126, and lower adaptor 114 have not moved relative to the mandrel 40. Thus, when the packer 10 is set, the release portion 124 of the packer 10 may remain unchanged.

Referring additionally now to FIGS. 6A–6D, the packer 10 is shown partially released, after having been set as shown in FIGS. 5A–5D and previously described hereinabove. The rubbers 44 are no longer axially compressed or radially outwardly extended and, thus, are no longer in sealing engagement with the casing 146. The casing slips 80 are no longer radially outwardly extended and, thus, no longer anchor the packer 10 to the casing 146.

Figure 6A:
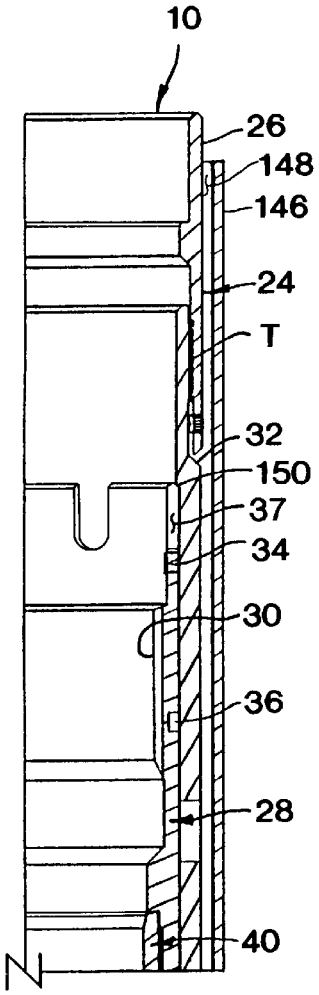
FIGS. 6A–6D are quarter-sectional views of successive axial portions of the packer, illustrating a partially released configuration thereof.
Figure 6B:
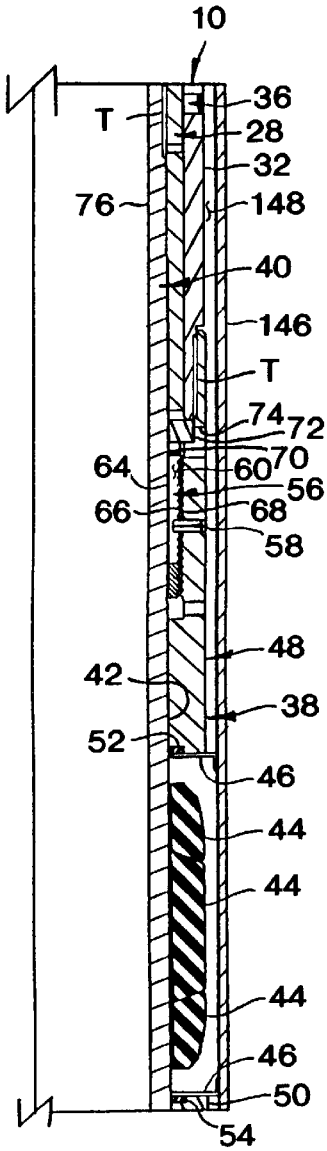
Figure 6C:
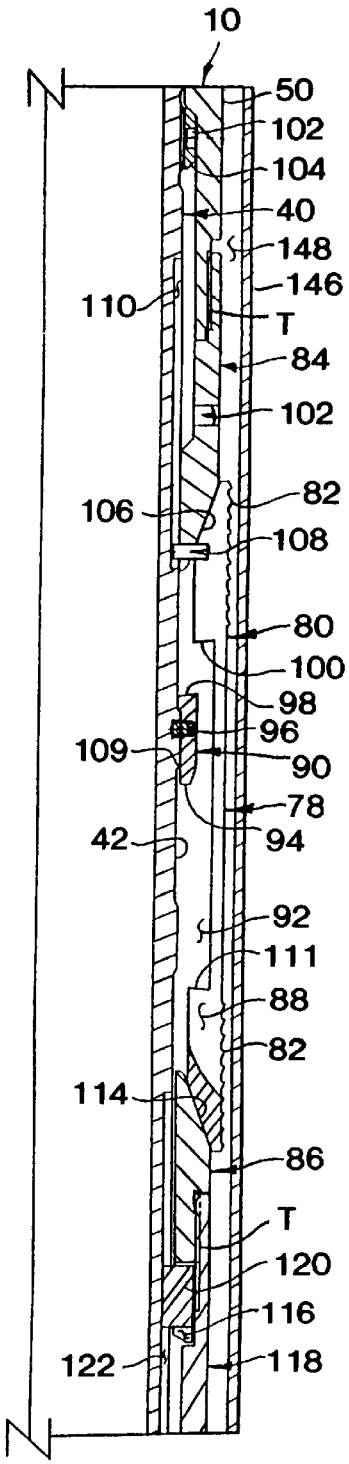
Figure 6D:
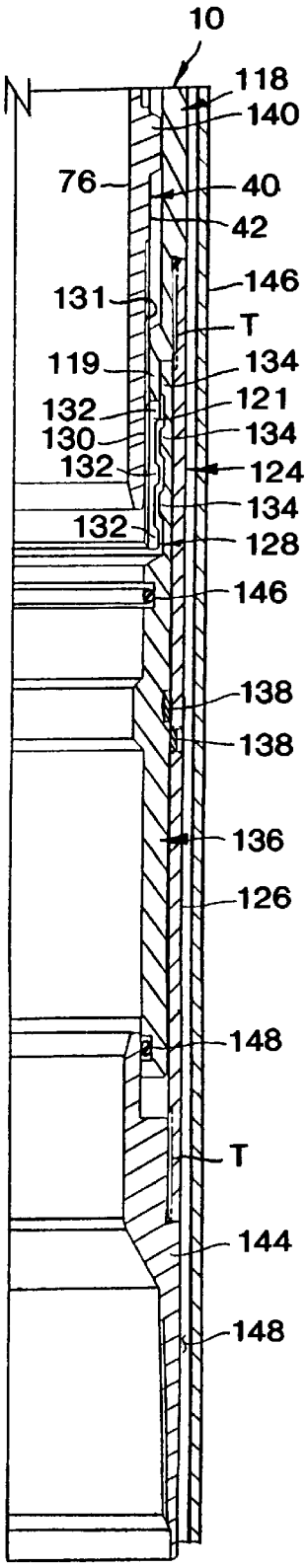

Referring specifically now to FIG. 6D, the release sleeve 136 has been shifted axially upward relative to the housing 118, shearing shear screws 138, and permitting C-ring 128 to flex radially outward. Such radially outward flexing of the C-ring 128 permits the teeth 130 and 131 to disengage, thereby permitting the mandrel 40 to move axially upward relative to the housing 118. Note that the radially enlarged portion 140 on the mandrel 40 no longer axially contacts the stop ring 119. Note, also, that only a relatively short axially upward movement of the release sleeve 136 is required to disengage the multiple spaced apart radial projections 132 and 134 on the C-ring 128 and release sleeve, respectively.

Referring specifically now to FIG. 6C, the casing slips portion 78 of the packer 10 is shown. The axially upward movement of the mandrel 40 relative to the housing 118 permits the lower wedge 86 to move axially downward relative to the mandrel 40, and relative to the casing slips 80, thereby permitting the casing slips to radially inwardly retract. Teeth 82 no longer bite into the casing 146. Note that the keys 120 have axially downwardly displaced in the keyways 122, and that the clutch 90 has axially upwardly displaced relative to the casing slips 80. Note, also, that the split ring 104 now axially contacts the lower compression member 50.

Referring specifically now to FIG. 6B, the sealing portion 38 of the packer 10 is shown. The lower compression member 50 has been displaced axially downward relative to the mandrel 40 and the upper compression member 48, thereby permitting the rubbers 44 to axially expand. The protective sleeves 46 remain deformed and radially outwardly contact the casing 146, but due to their flexibility, do not prevent the packer 10 from being axially displaced relative to the casing, nor do they effect a seal to an appreciable extent. Note that, even though the forces acting to compress the rubbers 44 and radially outwardly extend the casing slips 80 have been released, the mandrel slip 56 still grippingly engages the mandrel 40, preventing axially downward movement of the mandrel relative to the upper housing 32.

Referring specifically now to FIG. 6A, the upper portion 24 of the packer 10 is shown. Mandrel 40 has been permitted to move axially upward relative to the upper housing 32 as described hereinabove, and the top sub 28 now contacts a radially inwardly extending shoulder 150 formed on the upper housing, thereby preventing further axially upward movement of the mandrel relative to the upper housing.

Referring additionally now to FIGS. 7A–7D, the packer 10 is shown fully released and is now configured for retrieval from the well. The packer 10 is retrieved by the service tool (not shown) which is threaded into the threads 30 on the top sub 28 as described hereinabove. An axially upward force is thereby applied to the top sub 28 to withdraw the packer 10 from the well.

Figure 7A:
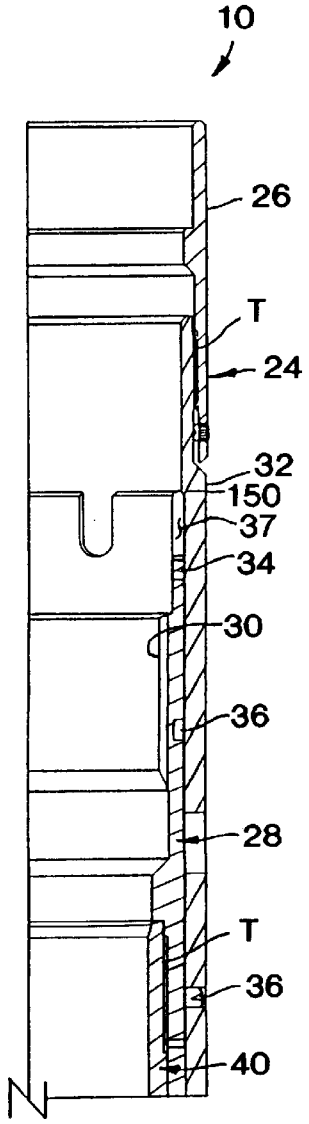
FIGS. 7A–7D are quarter-sectional views of successive axial portions of the packer, illustrating a fully released configuration thereof.

Referring specifically now to FIG. 7A, the top sub 28 is in axial contact with the shoulder 150 on the upper housing 32. Therefore, an axially upward force applied to the top sub 28 by the service tool will also act to axially upwardly displace the upper housing 32. Thus, the upper adaptor 26, upper housing 32, top sub 28, and mandrel 40 are axially upwardly displaced when the axially upward force is applied to the top sub.

Figure 7B:
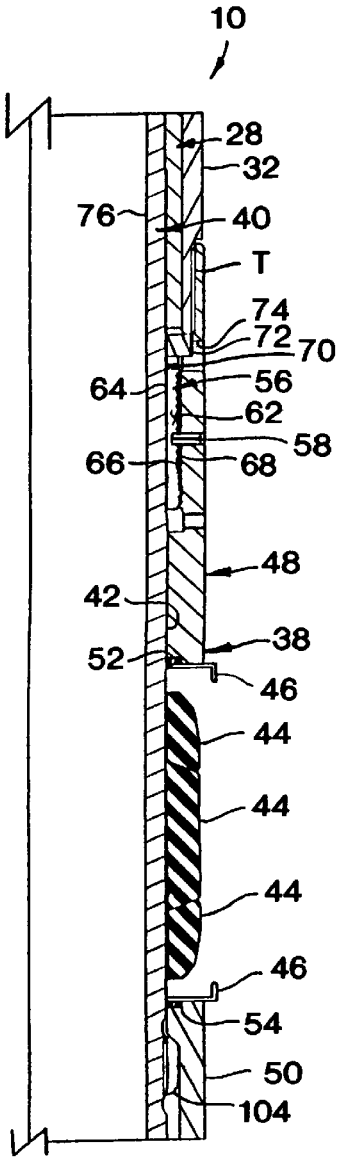

Referring specifically now to FIG. 7B, the upper compression member 48, being attached to the upper housing 32, is also axially upwardly displaced, preventing the rubbers 44 from being inadvertently compressed while the packer 10 is retrieved from the well. As described hereinabove the split ring 104 is in axial contact with the lower compression member 50 on the mandrel 40. Thus, when the mandrel 40 is axially upwardly displaced, the lower compression member 50 is also axially upwardly displaced.

Figure 7C:
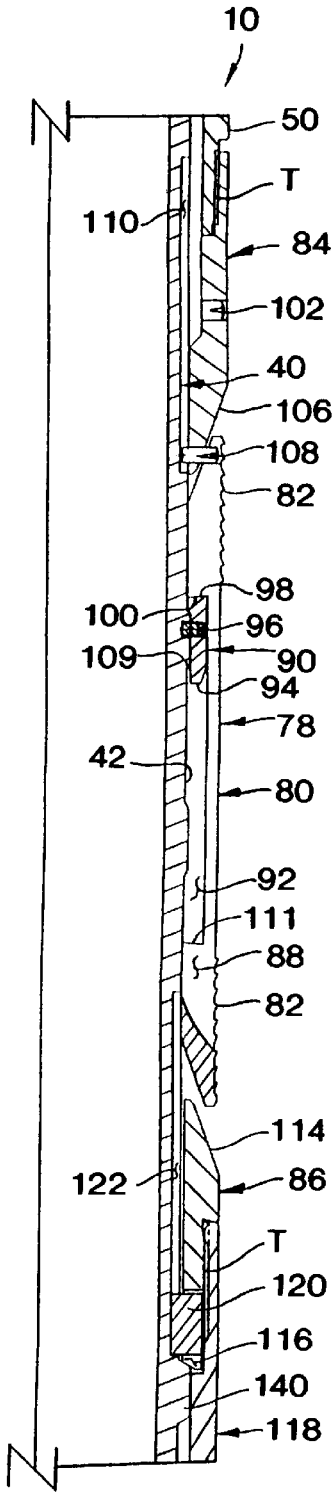

Referring specifically now to FIG. 7C, the upper wedge 84, being attached to the lower compression member 50 is also axially upwardly displaced when the mandrel 40 is axially upwardly displaced. The conical surface 106 no longer rampingly contacts the casing slips 80, and the casing slips are permitted to completely radially inwardly retract. Sloping upper end surface 98 on the clutch 90 now axially contacts the sloping surface 100 on the casing slips 80, thereby maintaining a radially inwardly biasing force on the casing slips as the packer 10 is retrieved from the well. Axial contact between the casing slips 80 and the clutch 90 also axially upwardly displaces the casing slips as the mandrel 40 is axially upwardly displaced, thereby preventing inadvertent setting of the casing slips as the packer 10 is retrieved from the well. Radially outwardly extending portion 140 on the mandrel 40 axially contacts the lower wedge 86 adjacent slots 116, thereby axially upwardly displacing the lower wedge, along with the housing 118 which is attached thereto, as the mandrel is axially upwardly displaced.

Figure 7D:
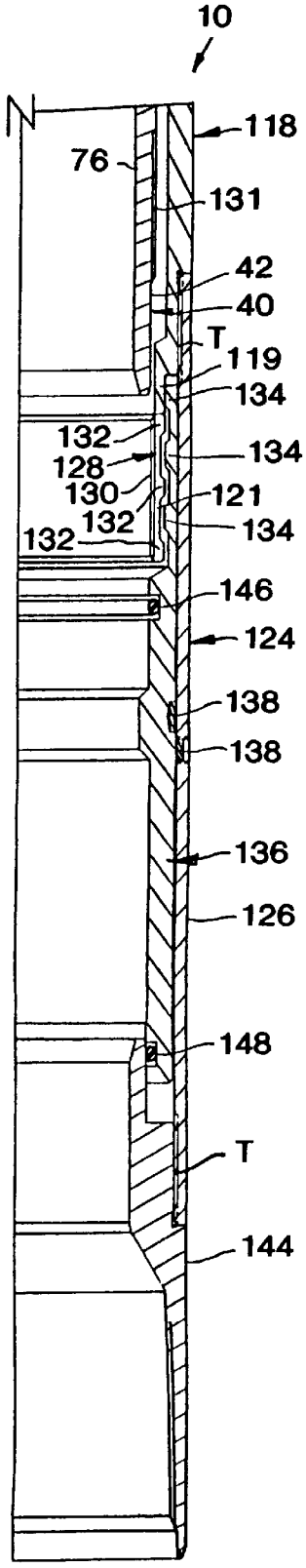

Referring specifically now to FIG. 7D, the mandrel 40 has been displaced axially upward relative to the housing 118, the teeth 131 on the mandrel no longer being in engagement with the teeth 130 on the C-ring 128. Note that, as the housing 118 is axially upwardly displaced, the lower housing 126, C-ring 128, release sleeve 136, and lower adaptor 144 are also axially upwardly displaced.

The foregoing detailed description is to be clearly understood as being given by way of illustration and example only, the spirit and scope of the present invention being limited solely by the appended claims.

What is claimed is:

1. A packer operatively positionable in a subterranean wellbore, the packer comprising:

a tubular mandrel having an exterior side surface;

a tubular casing slip coaxially and slidingly disposed on said mandrel exterior side surface, said slip having a circumferentially spaced apart series of axial slots formed thereon, an internal side surface radially spaced apart from said mandrel exterior side surface, and first and second end portions axially straddling said internal surface; and a ring secured to said mandrel exterior surface radially intermediate said slip internal surface and said mandrel exterior surface, and said ring being disposed axially intermediate said first and second end portions, such that said ring axially restricts displacement of said slip relative to said mandrel.

2. The packer according to claim 1, wherein said ring has an axially extending projection formed thereon, said projection being inserted into one of said slots when said ring is adjacent said first end portion of said slip, such that said projection restricts rotational movement of said slip relative to said mandrel.

3. The packer according to claim 1, wherein said ring has a series of circumferentially spaced apart and axially extending projections formed thereon, each of said projections being inserted into one of said slots when said ring is adjacent said first end portion of said slip, such that said projections restrict rotational movement of said slip relative to said mandrel, and said projections being released from said slots when said ring is adjacent said second end portion of said slip.

4. The packer according to claim 1, wherein said ring has an axially sloping end surface formed thereon, and wherein said slip has a complementarily shaped axially sloping surface on said second end portion, said ring sloping end surface engaging said slip sloping surface when said ring is adjacent said second end portion to thereby apply a radially inwardly biasing force to said slip.

5. The packer according to claim 4, wherein said ring has a series of circumferentially spaced apart and axially extending projections formed thereon, each of said projections being inserted into one of said slots when said ring is adjacent said first end portion of said slip.

6. The packer according to claim 1, wherein said mandrel further has an axially extending slot formed on said exterior surface, and further comprising:

a tubular wedge member coaxially disposed on said mandrel exterior surface, said wedge member having a radially sloping end surface formed externally thereon, and said radially sloping end surface being adjacent said casing slip second end portion; and an elongated retainer member, said retainer member being installed laterally through said wedge member and secured therein, said retainer member extending laterally into said mandrel slot and being in axially sliding engagement therein, said retainer member extending laterally into one of said casing slip slots and being in axially sliding engagement therewith, said retainer member securing said wedge member against rotation relative to said mandrel, and said retainer member securing said casing slip against rotation relative to said wedge member.

7. A packer operatively positionable in a subterranean wellbore, the packer comprising:

a tubular mandrel having an exterior side surface, said exterior side surface having a first series of axially extending threads formed thereon;

an axially compressible annular seal member, said seal member being coaxially disposed on said mandrel exterior surface;

a radially extendable slip member, said slip member being disposed on said mandrel exterior surface axially spaced apart from said seal member;

a tubular sleeve coaxially disposed on said mandrel exterior surface axially intermediate said seal member and said slip member, said sleeve having first and second opposite end portions and an internal side surface radially spaced apart from said mandrel exterior surface, said first end portion having a radially extending external end surface facing said seal member for axially compressing said seal member, said second end portion having a radially sloping external end surface facing said slip member for radially extending said slip member when said slip member rampingly engages said radially sloping end surface; and a ring disposed on said mandrel exterior surface radially intermediate said sleeve internal surface and said mandrel exterior surface, and said ring being axially intermediate said sleeve first and second end portions, said ring having an internal side surface and first and second opposite ends, said ring internal surface having a second series of axially extending threads formed thereon, and said second threads cooperatively engaging said first threads.

8. The packer according to claim 7, wherein said sleeve is axially slidingly disposed on said mandrel exterior surface, said sleeve being slidable from a first position relative to said mandrel wherein said ring first end contacts said first end portion to a second position relative to said mandrel wherein said ring second end contacts said second end portion, and said sleeve being axially retained on said mandrel exterior surface by said ring.

9. The packer according to claim 7, wherein said sleeve first end portion is coaxially and threadedly attached to said sleeve second end portion, such that said first end portion is axially separable from said second end portion for removal of said first and second end portions from said mandrel.

10. The packer according to claim 9, wherein said ring has a slot formed therethrough, said slot permitting radially outward expansion of said ring, such that when said first and second end portions are axially separated, said ring is capable of being radially outwardly expanded to separate said first threads from said second threads.

11. The packer according to claim 7, further comprising a retainer, said retainer being installed laterally through said sleeve and into said ring, and said retainer releasably securing said sleeve against axial displacement relative to said mandrel.

12. The packer according to claim 7, further comprising:

a tubular structure slidingly disposed on said mandrel exterior side surface, said structure being capable of axially compressing said seal member when said structure is slidingly displaced on said mandrel exterior side surface in a first axial direction relative to said mandrel; and a tubular mandrel slip carried on said structure, said mandrel slip being slidingly disposed on said mandrel exterior side surface, said mandrel slip having a first spaced apart series of teeth formed on an internal side surface thereof and a second spaced apart series of teeth formed on an external side surface thereof, said first teeth grippingly engaging said mandrel exterior side surface and being angled to permit sliding displacement of said structure in said first axial direction, said structure further having a third spaced apart series of teeth formed on an internal side surface thereof, said third teeth cooperatively engaging said second teeth to apply a radially inwardly directed force to said mandrel slip when said structure is biased in a second axial direction on said mandrel exterior surface opposite to said first axial direction.

13. A packer operatively positionable in a subterranean wellbore, the packer comprising:

a tubular mandrel having an exterior side surface, first and second axially spaced apart and axially extending recesses formed on said mandrel exterior surface, and an end;

a tubular top sub coaxially attached to said mandrel end and extending axially outwardly therefrom;

a tubular upper housing coaxially and radially outwardly overlying said top sub;

a first retainer member inserted laterally through said upper housing and into said top sub, said first retainer member releasably securing said upper housing against rotational displacement relative to said top sub;

a tubular casing slip coaxially and slidingly disposed on said mandrel exterior surface, said casing slip having a circumferentially spaced apart series of axial slots formed thereon, an internal side surface radially spaced apart from said mandrel exterior surface, and first and second end portions axially straddling said internal surface;

a ring secured to said mandrel exterior surface radially intermediate said casing slip internal surface and said mandrel exterior surface, said ring being disposed axially intermediate said first and second end portions, and said ring having a series of axially extending and circumferentially spaced apart projections formed thereon, each of said projections being disposed in a corresponding one of said casing slip slots and thereby securing said casing slip against rotational displacement relative to said mandrel;

first and second tubular wedge members coaxially disposed on said mandrel exterior surface axially straddling said casing slip, said second wedge member having an opening formed laterally therethrough;

a second retainer member installed laterally through said first wedge member, said second retainer member extending laterally into said first recess, said second retainer member extending laterally into one of said casing slip slots, and said second retainer member securing said first wedge member against rotational displacement relative to said mandrel and said casing slip; and a third retainer member installed laterally through said second wedge member opening and into said second recess, said third retainer member securing said second wedge member against rotational displacement relative to said mandrel, whereby, when said top sub is rotated, said mandrel, said upper housing, said first and second wedge members, said ring, and said casing slip rotate with said top sub.

14. A packer operatively positionable in a subterranean well, the packer comprising:

an inner mandrel;

a structure extending outwardly from the mandrel in a fixed relationship therewith, and a generally tubular casing slip having opposite ends and a recess formed on an inner side surface of the slip between the opposite ends, the structure extending into the recess and permitting axial displacement of slip relative to the structure.

15. The packer according to claim 14, wherein the structure is a ring.

16. The packer according to claim 14, wherein the structure is releasably attached to an outer side surface of the mandrel.

17. The packer according to claim 14, wherein the slip further has at least one slot formed thereon, the structure engaging the slot and thereby preventing rotation of the slip relative to the mandrel.

18. The packer according to claim 14, wherein each of the structure and the slip has a sloped surface formed thereon, the sloped surfaces engaging each other and inwardly displacing the slip relative to the mandrel.

19. The packer according to claim 14, further comprising a wedge member displaceable relative to the slip to thereby outwardly extend the slip, and the wedge member being rotationally secured relative to the slip.

20. The packer according to claim 19, wherein the wedge member is rotationally secured relative to the mandrel.

21. A packer operatively positionable in a subterranean well, the packer having an unset position and comprising:

an inner mandrel; and a casing slip, the slip being axially displaceable and rotationally secured relative to the mandrel when the packer is in its unset position.

22. The packer according to claim 21, further comprising at least one wedge member operative to outwardly displace the slip relative to the mandrel, the wedge member being rotationally secured relative to the mandrel.

23. The packer according to claim 21, wherein the slip is generally tubular.

* * * * *